US012352021B2

(12) United States Patent
Tracy et al.

(10) Patent No.: US 12,352,021 B2
(45) Date of Patent: Jul. 8, 2025

(54) FAUCET HAVING A PLURALITY OF SPRAY PATTERNS

(71) Applicant: ASSA ABLOY Americas Residential Inc., New Haven, CT (US)

(72) Inventors: Adam William Tracy, Irvine, CA (US); Andy Ejung Kim, Lake Forest, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 246 days.

(21) Appl. No.: 17/998,913

(22) PCT Filed: May 11, 2021

(86) PCT No.: PCT/US2021/031818
§ 371 (c)(1),
(2) Date: Nov. 15, 2022

(87) PCT Pub. No.: WO2021/231458
PCT Pub. Date: Nov. 18, 2021

(65) Prior Publication Data

US 2023/0193606 A1 Jun. 22, 2023

Related U.S. Application Data

(60) Provisional application No. 63/025,386, filed on May 15, 2020.

(51) Int. Cl.
*E03C 1/04* (2006.01)

(52) U.S. Cl.
CPC ..... *E03C 1/0405* (2013.01); *E03C 1/0412* (2013.01); *Y10T 137/9464* (2015.04)

(58) Field of Classification Search
CPC . E03C 1/0405; E03C 1/0412; Y10T 137/9464
(Continued)

(56) References Cited

U.S. PATENT DOCUMENTS 1,105,547 A * 7/1914 Coffield ..... E03B 9/20 239/25
1,149,856 A * 8/1915 Piper ..... B01D 35/043 285/190

(Continued)

FOREIGN PATENT DOCUMENTS

CN 203417785 U 2/2014
CN 205995652 U 3/2017

(Continued)

OTHER PUBLICATIONS

International Search Report and Written Opinion for PCT/US2021/031818 (Sep. 3, 2021).

*Primary Examiner* — Daphne M Barry
(74) *Attorney, Agent, or Firm* — Merchant & Gould P.C.

(57) ABSTRACT

A faucet includes a faucet body, a faucet spout and a spray pattern controller for providing a plurality of spray patterns. The faucet body includes a faucet handle that is movable with respect to the faucet body. The faucet spout has a first end extending from and integral to the faucet body. The spray pattern controller is located along a side of the faucet spout. The spray pattern controller is configured to adjust a spray pattern. The faucet spout may include at least first and second selectable outlets, and water flow through the outlets is selectably managed by the spray pattern controller to select a spray pattern from a plurality of spray patterns capable of being dispensed through the faucet spout.

17 Claims, 9 Drawing Sheets

(58) Field of Classification Search
USPC ..... 137/801
See application file for complete search history.

(56) References Cited

U.S. PATENT DOCUMENTS 2,245,041 A * 6/1941 McCurdy ..... E03B 9/20 137/625.48
2,524,956 A * 10/1950 Brunetti ..... E03C 1/086 137/118.01
2,579,769 A * 12/1951 Tyler ..... E03C 1/086 239/25
2,988,288 A * 6/1961 Nielsen ..... E03C 1/084 239/590.5
2,994,481 A * 8/1961 Blumberg ..... E03C 1/086 239/432
3,079,088 A * 2/1963 Hermann ..... E03C 1/086 137/625.46
3,144,878 A * 8/1964 Williams ..... E03C 1/08 239/444
3,208,477 A * 9/1965 Gabriel ..... F16K 1/22 251/153
3,325,101 A * 6/1967 Cuschera ..... E03B 9/20 239/25
3,335,957 A * 8/1967 Jacobson ..... E03B 9/20 100/901
3,552,651 A * 1/1971 Garrison ..... B05B 17/08 137/625.41
3,580,503 A * 5/1971 Ligon ..... E03C 1/084 239/25
3,998,390 A 12/1976 Peterson et al.
RE30,350 E 7/1980 Peterson et al.
4,448,351 A * 5/1984 Aldinger ..... E03C 1/08 239/447
4,609,006 A * 9/1986 Parkison ..... F16K 19/00 137/854
4,762,273 A * 8/1988 Gregory ..... E03C 1/057 236/93 R
5,158,234 A * 10/1992 Magnenat ..... E03C 1/0405 239/582.1
5,195,681 A * 3/1993 Chyen ..... E03B 9/20 4/678
6,131,608 A * 10/2000 Lu ..... F16K 31/385 137/550
6,367,707 B1 * 4/2002 Kang ..... E03C 1/04 239/447
7,051,959 B2 5/2006 Lim
7,090,144 B2 * 8/2006 Gross ..... E03B 9/20 137/625.48
7,216,820 B2 5/2007 Nelson et al.
7,850,098 B2 * 12/2010 Vogel ..... B05B 1/14 239/383
8,162,236 B2 * 4/2012 Rodenbeck ..... G05D 23/1353 239/447
8,757,518 B2 * 6/2014 Kao ..... B05B 1/1609 239/443
8,840,045 B2 9/2014 Thurin et al.
9,138,756 B2 9/2015 Schroeder
9,175,459 B2 * 11/2015 Zhang ..... E03C 1/02
9,487,935 B2 * 11/2016 Waddell ..... E03C 1/0404
9,545,639 B2 * 1/2017 Meehan ..... B05B 12/0022
9,896,826 B2 * 2/2018 Yuan ..... E03C 1/057
10,060,540 B2 * 8/2018 Cutler ..... F16K 11/044
10,287,761 B2 * 5/2019 Yuan ..... F16K 31/44
11,155,984 B2 * 10/2021 Waddell ..... E03C 1/0404
12,006,671 B2 * 6/2024 Macsay ..... E03C 1/0405
2005/0098485 A1 * 5/2005 Boyd ..... E03C 1/08 210/100
2006/0219822 A1 * 10/2006 Miller ..... B05B 1/30 239/581.1
2009/0113619 A1 * 5/2009 Tichenor ..... E03C 1/08 4/619
2009/0212123 A1 * 8/2009 Crutcher ..... A63H 3/28 239/25
2010/0252115 A1 * 10/2010 Bassols ..... E03C 1/08 251/231
2011/0290901 A1 * 12/2011 Dittman, III ..... E03C 1/0404 239/24
2014/0109311 A1 * 4/2014 Bosio ..... E03C 1/0405 4/678
2017/0058496 A1 * 3/2017 Chiu ..... F16K 31/44
2017/0342692 A1 11/2017 Hu
2019/0001351 A1 1/2019 Mickos
2019/0071850 A1 * 3/2019 Waddell ..... F16K 31/602
2020/0063408 A1 2/2020 Tracy et al.
2020/0248438 A1 * 8/2020 Wang ..... E03C 1/0405
2022/0325508 A1 * 10/2022 Kim ..... E03C 1/0405

FOREIGN PATENT DOCUMENTS

EP 3248689 A1 11/2017
EP 3277433 B1 11/2021
JP 06116997 A 4/1994
JP 2003-024932 A 1/2003
JP 2009225884 A 10/2009
WO 201036241 A1 4/2010
WO 2019/010078 A1 1/2019

* cited by examiner

FAUCET HAVING A PLURALITY OF SPRAY PATTERNS

CROSS-REFERENCE TO RELATED APPLICATION

This application is a U.S. National Stage Application of PCT/US2021/031818, filed May 11, 2021, which claims the benefit of priority to U.S. Provisional Application No. 63/025,386, filed May 15, 2020, which applications are incorporated herein by reference. To the extent appropriate, a claim of priority is made to each of the above-disclosed applications.

TECHNICAL FIELD

The present disclosure relates generally to faucets. In particular, the present disclosure relates to a faucet having a plurality of spray patterns.

BACKGROUND

Faucets capable of producing more than one spray pattern generally include a mechanical means located on a pull-out faucet head for adjusting a spray pattern of the water. The spray head may include a button that allows a user to press to change the spray pattern being dispensed, for example by moving a valve within the spray head to redirect a water flow path. Faucets with multiple spray patterns typically comprise mechanical parts to control the temperature and flow of water. In many situations, a mechanical switch controls the water flow through one or more spray head designs of a kitchen faucet.

However, faucets without pull out spray heads, such as bathroom faucets, generally do not have multiple spray patterns. Further, currently available faucets with such buttons are not aesthetically pleasing.

SUMMARY

The present disclosure relates generally to a faucet. In one possible configuration, and by non-limiting example, the faucet includes a spray pattern controller configured to provide a plurality of different spray patterns.

In one aspect of the present disclosure, a faucet is disclosed. The faucet includes a faucet body, a faucet spout, and a spray pattern controller. The faucet body includes a faucet handle that is movable with respect to the faucet body. The faucet spout has a first end that extends from and is integral to the faucet body and has a second end having a first outlet and a second outlet. A spray pattern controller is located along a side of the faucet spout, the spray pattern controller configured to adjust a spray pattern selected from a plurality of spray patterns being dispensed through the faucet spout through at least one of the first outlet or the second outlet.

In another aspect of the present disclosure, a method of controlling a spray pattern dispensed from a faucet is disclosed. The method includes receiving a manual input from a spray pattern controller, the spray pattern controller located adjacent an end of a faucet spout including a first outlet and a second outlet and positioned to actuate a valve between open and closed positions. When the valve is in the open position, water flows through the first outlet in a first spray pattern. When the valve is in the closed position, the water flows through the second outlet in a second spray pattern that is different than the first spray pattern.

In another aspect of the present disclosure, a faucet is described. The faucet includes a faucet body, a faucet spout, and a spray pattern controller. The faucet body includes a faucet handle that is movable with respect to the faucet body to manipulate a cartridge configured to control water flow at the faucet. The faucet body extends from a faucet base located at a sink deck. The faucet spout extends from and is integral to the faucet body, extending from a first end to a second end. The faucet spout has a first outlet and a second outlet at the second end. The faucet includes a spray pattern controller adjacent the second end of the faucet spout, the spray pattern controller being operatively engaged with a push seal at the first outlet, the spray pattern controller configured to adjust a spray pattern selected from a plurality of spray patterns being dispensed through the spout by toggling between output from the first outlet or the second outlet.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
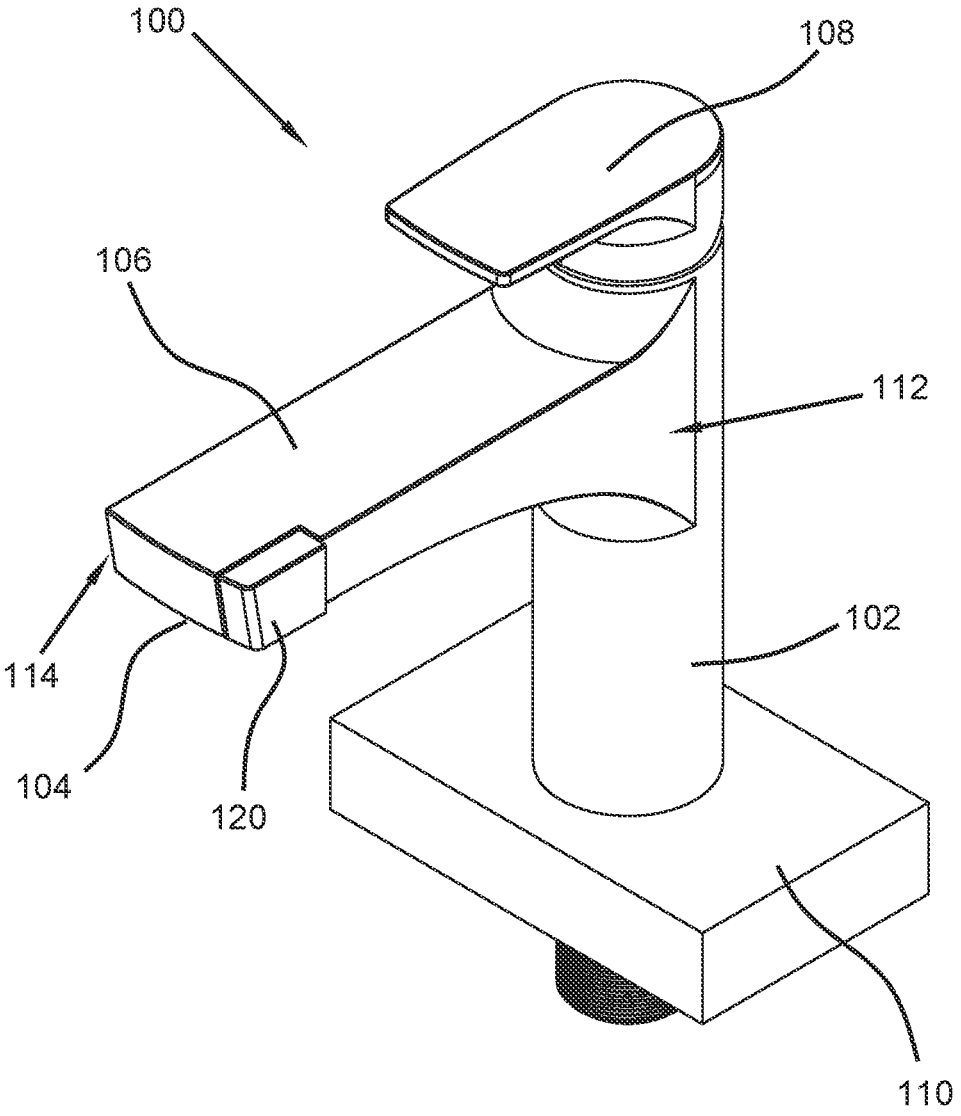
FIG. 1 illustrates a perspective view of a faucet with a spray pattern controller.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

In accordance with the present disclosure, a faucet is disclosed having multiple spray patterns. Such a faucet may have a plurality of outlets, and may be controllable via a manual switching mechanism that manipulates a valve and/or water flow path within the faucet. In example applications, such a faucet is well-suited to provide for different types of activities in a bathroom setting. For example, rinsing a toothbrush or razor requires a more powerful stream with a focused area, whereas handwashing requires a softer spray covering a wider area. The faucet as described herein includes a spray pattern controller, such as a switch or push button that adjusts a spray pattern of the faucet. A first spray pattern may be a more powerful spray pattern that covers a smaller area, and a second spray pattern may be a softer spray pattern that covers a wider area.

In general, and as discussed herein, the plurality of spray patterns described herein may provide advantageous performance regarding a particular set of applications, including those which may be encountered in a bathroom environment. For example, a comparatively lower-height faucet may not be amenable to a pull-down or pull-out configuration, and may instead have different aesthetic concerns which render such pull out configurations undesirable. In these situations, particularly where the height of the faucet is somewhat lower and the associated sink is typically somewhat shallower, other ways in which improved operability are sought. Accordingly, in some examples described herein, different flow patterns may be provided by different outlets which are easily selected via an aesthetically-pleasing manual toggle. The different flow patterns may be, for example different in pressure, different in spray pattern, different in cross-sectional area covered, different in direction, or some combination thereof.

FIG. 1 is a perspective view of an example faucet 100 according to an embodiment of the disclosure. In the example shown, the faucet 100 includes a faucet body 102 connected to a faucet spout 106, an outlet portion 104, a handle 108, and a spray pattern controller 120.

The faucet body 102, as shown, extends upward from a faucet base 110 and then a faucet spout 106 extends generally perpendicular from the faucet body 102. However, the faucet body 102 and faucet spout 106 can be shaped differently to provide a different connection between the faucet body 102 and the faucet spout 106. The faucet spout 106 has a first end 112 extending from the faucet body 102, and the outlet portion 104 is located at a second end 114 of the faucet spout 106. The handle 108 can manually control the water flow through the faucet spout 106 (e.g., based on manipulation of a cartridge, not shown) based on user-actuated movement. In a first embodiment, the handle 108 is integral to the faucet body 102 and faucet spout 106. In an alternative embodiment, the handle 108 is a standalone handle and is separate from the faucet body 102.

The outlet portion 104 and faucet spout 106 extend from and are integral to the faucet body 102. In the embodiment as shown, the faucet 100 does not include a moveable outlet portion 104. The faucet body 102 and faucet spout 106 are a rigid unitary body.

The spray pattern controller 120 may be located offset from the middle of the faucet spout 106 and at a second end 114 of the faucet spout 106. Further, the spray pattern controller 120 may be shaped to have the same exterior shape as the faucet spout 106, so as to provide an aesthetically pleasing design. In another embodiment, different shapes and/or appearances of the spray pattern controller 120 are envisioned. In the embodiments shown, the spray pattern controller 120 is located at the outlet portion 104. In other embodiments, the spray pattern controller 120 may be located at various positions along the faucet spout 106, discussed in further detail below.

In the example embodiment shown, the spray pattern controller 120 is located at the outlet portion 104. The spray pattern controller 120 may be a mechanical switch. In a first embodiment, the spray pattern controller 120 is a toggle switch. The spray pattern controller 120 having a toggle switch has a first configuration that produces a first spray pattern and a second configuration that has a second spray pattern. In another embodiment, the spray pattern controller 120 is a push button A push button has a first configuration where the push button is not depressed, and a second configuration where the push button is depressed, causing switching between at least a first spray pattern and a second spray pattern. In yet another embodiment, the spray pattern controller 120 is a rotary dial. A rotary dial may have a first position that produces a first spray pattern and a second position that produces a second spray pattern.

In a first configuration, the spray pattern controller 120 aligns with the shape of the faucet spout 106, and, as shown below as described in FIG. 2, the spray pattern controller 120 is biased or canted relative to the faucet spout 106 in the second configuration. Other types of spray pattern controllers 120 are envisioned, such as a push button, dial, or other similar mechanism.

Figure 2:
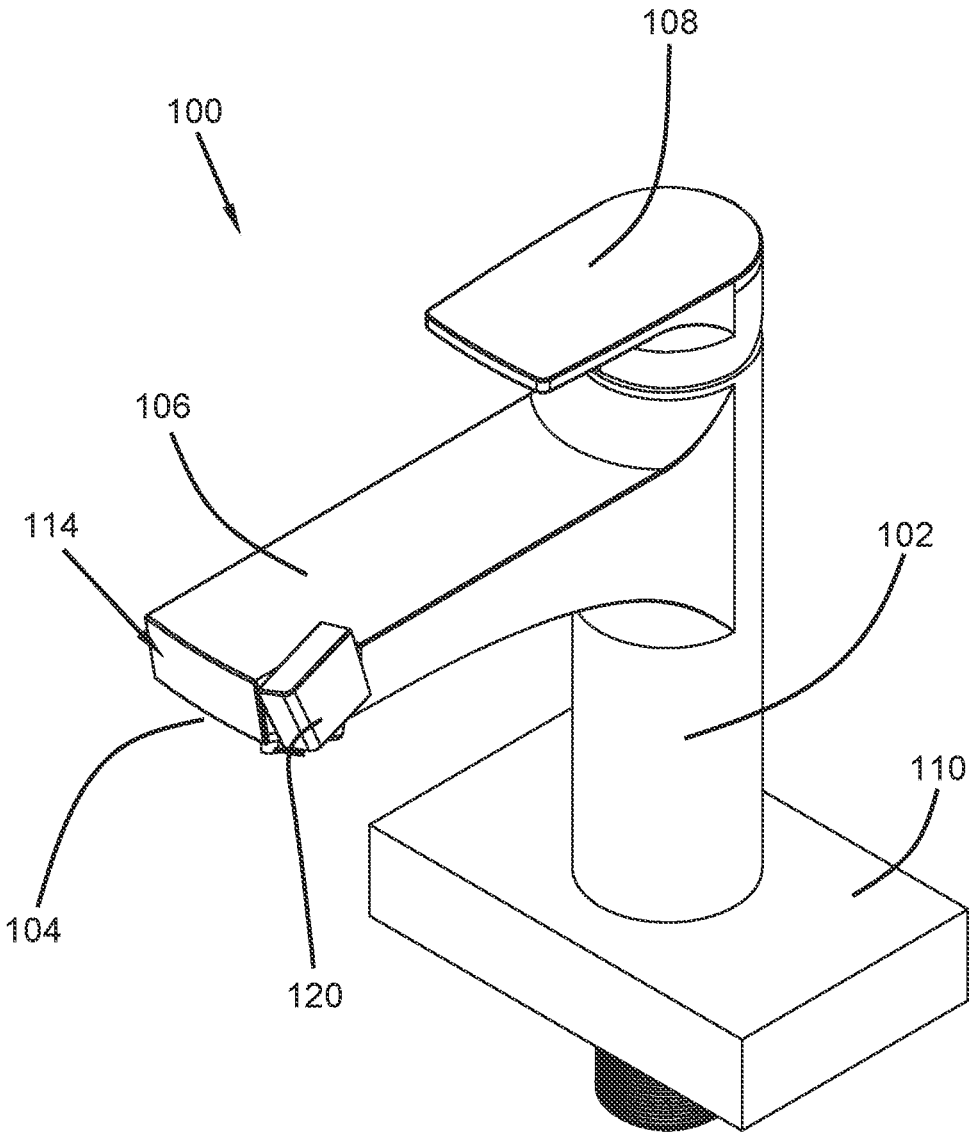
FIG. 2 illustrates a perspective view of the faucet of FIG. 1 with the spray head controller in an actuated position.

FIG. 2 illustrates a view of the faucet 100 with the spray pattern controller 120 in a biased position or actuated configuration. As shown, the spray pattern controller 120 is a toggle switch and is biased, or rotated, relative to the faucet spout 106. When the spray pattern controller 120 is rotated or pivoted from an initial position to the biased or second position, a second spray pattern is produced. Although as the spray pattern controller 120 is shown at a second end 114 of the faucet spout 106, the spray pattern controller 120 may be located anywhere along the faucet spout 106. In a further embodiment the spray pattern controller 120 may be located along the faucet body 102.

Figure 3:
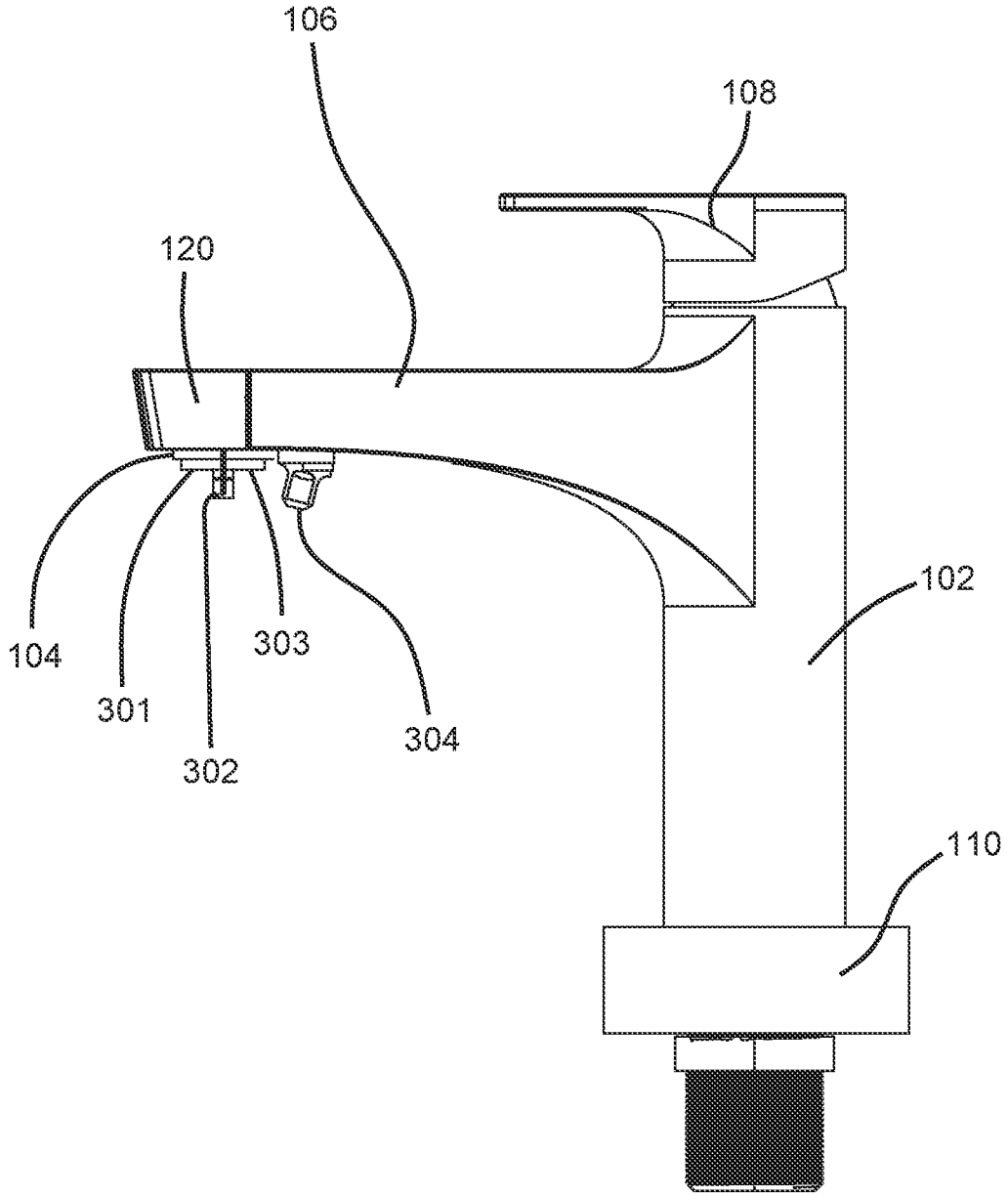
FIG. 3 illustrates a side view of the faucet of FIG. 1 with the spray head controller in an unactuated position.

FIG. 3 illustrates a side view of the faucet 100 showing a first outlet 301 and a second outlet 304. As illustrated, the first outlet 301 includes a push seal 302 and an aerator 303. The push seal 302 is controlled by the spray pattern controller 120. A check valve is included in the second outlet 304, and may cause water to be output from the second outlet 304 when a pressure within the faucet is above a predetermined threshold. As described in greater detail below, this may occur when the spray pattern controller 120 is used to close the push seal 302.

In particular, in the various embodiments discussed herein, the spray pattern controller 120 directs the flow of water through either the first outlet 301 or the second outlet 304. The first outlet 301 provides a first spray pattern having a first pressure and a first flow pattern cross-sectional area. This is due to inclusion of the aerator 303, which diffuses the water stream and provides a softer (lower pressure) water flow having a generally greater cross-sectional area. A variety of aerator designs may be used to provide different water flow patterns.

The second outlet 304 provides a second spray pattern having a second pressure and a second flow pattern cross-sectional area. The second spray pattern is different than the first spray pattern. For example, the second outlet 304 may lack an aerator and may be configured to only eject water if water pressure within the faucet is above a predetermined threshold; in such a case, while the first spray pattern is a softer spray pattern for washing hands or face due to the aerator 303, the second spray pattern through the second outlet 304 may be a powerful stream for rinsing everyday objects such as a toothbrush, razor, or retainer.

Figure 4:
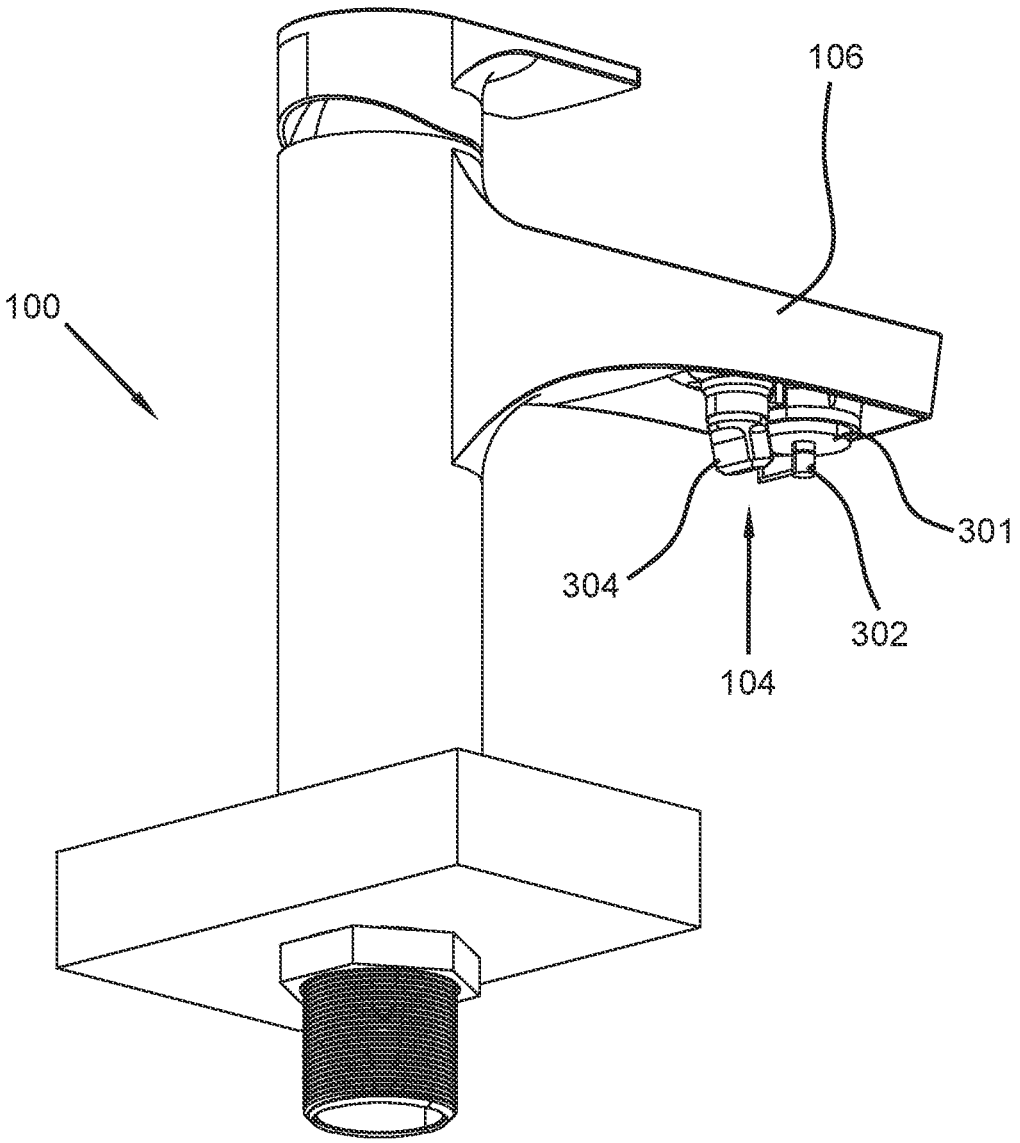
FIG. 4 illustrates an alternative view of the faucet of FIG. 1.

FIG. 4 illustrates an underside in view of the faucet 100, showing the first outlet 301 and second outlet 304 located at the outlet portion 104. As described in more detail below, water will flow through one of the first outlet 301 or the second outlet 304 depending on the actuation of the spray pattern controller 120 of the push seal 302.

Figure 5:
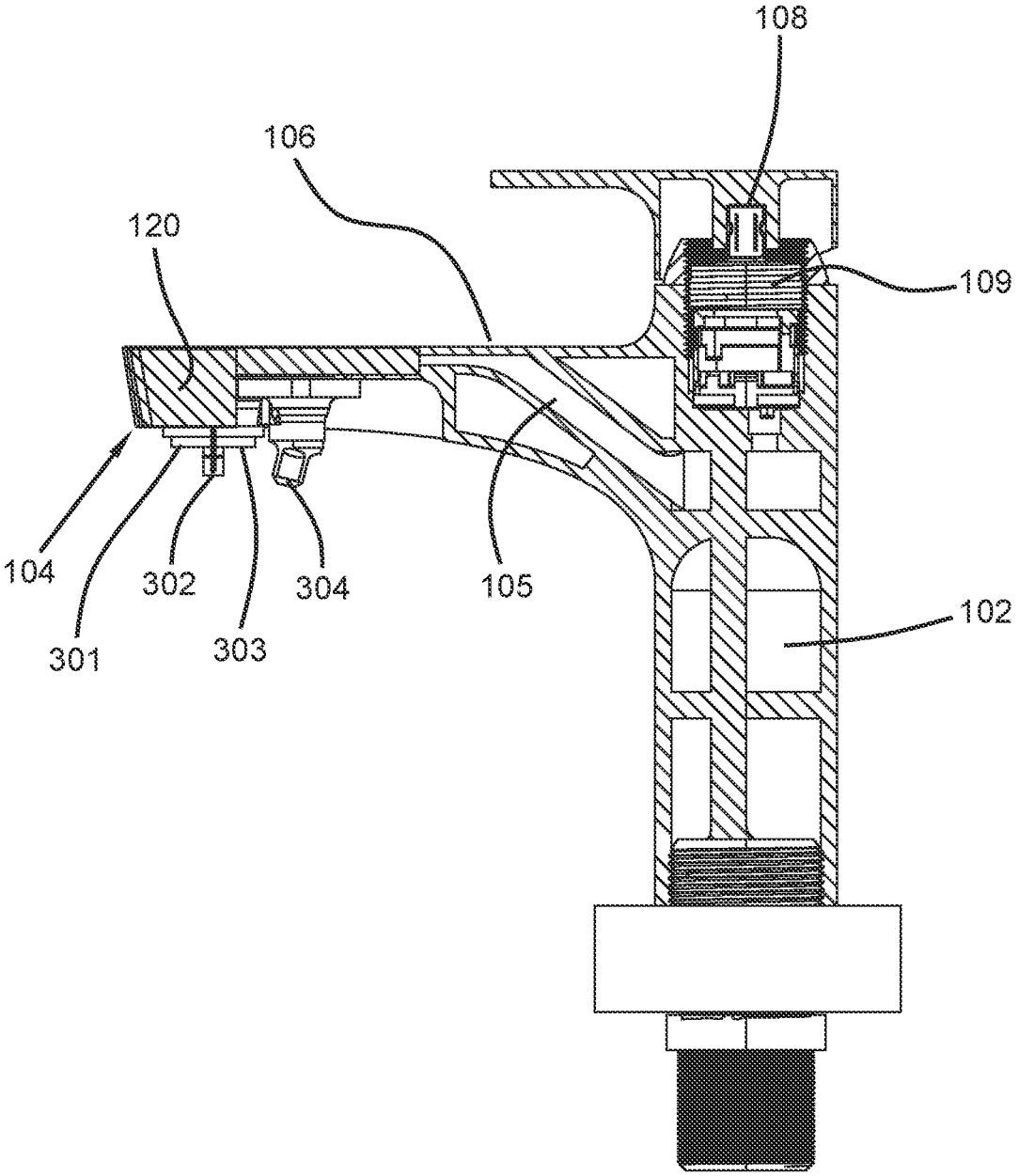
FIG. 5 illustrates a side cross-sectional view of the faucet of FIG. 1.

FIG. 5 illustrates a cross-sectional side view of the faucet 100. As shown, the handle 108 extends from the faucet body 102, and is interfaced to a cartridge 109 within the faucet 100 to control the flow of water through a water passageway 105 in the faucet spout 106 to the outlet portion 104. As shown, the spray pattern controller 120 is located at an end of the faucet spout 106 to control water flow through either the first outlet 301 or the second outlet 304, both of which are located at the outlet portion 104 of the faucet spout 106 at a location proximate to the spray pattern controller 120. In other embodiments, the handle 108 need not be connected to the faucet body 102, and instead is located on a sink deck next to the faucet body 102.

In other embodiments, the first outlet 301 and the second outlet 304 are located at the outlet portion 104 while the spray pattern controller 120 is located at a different position along the faucet spout 106. In such an arrangement, the spray pattern controller 120 may route water flow along two different paths, leading to the first outlet 301 or the second outlet 304. In such an arrangement, one or both of the check valve (described below) or push seal 302 may not be required to be included in the faucet.

Figure 6:
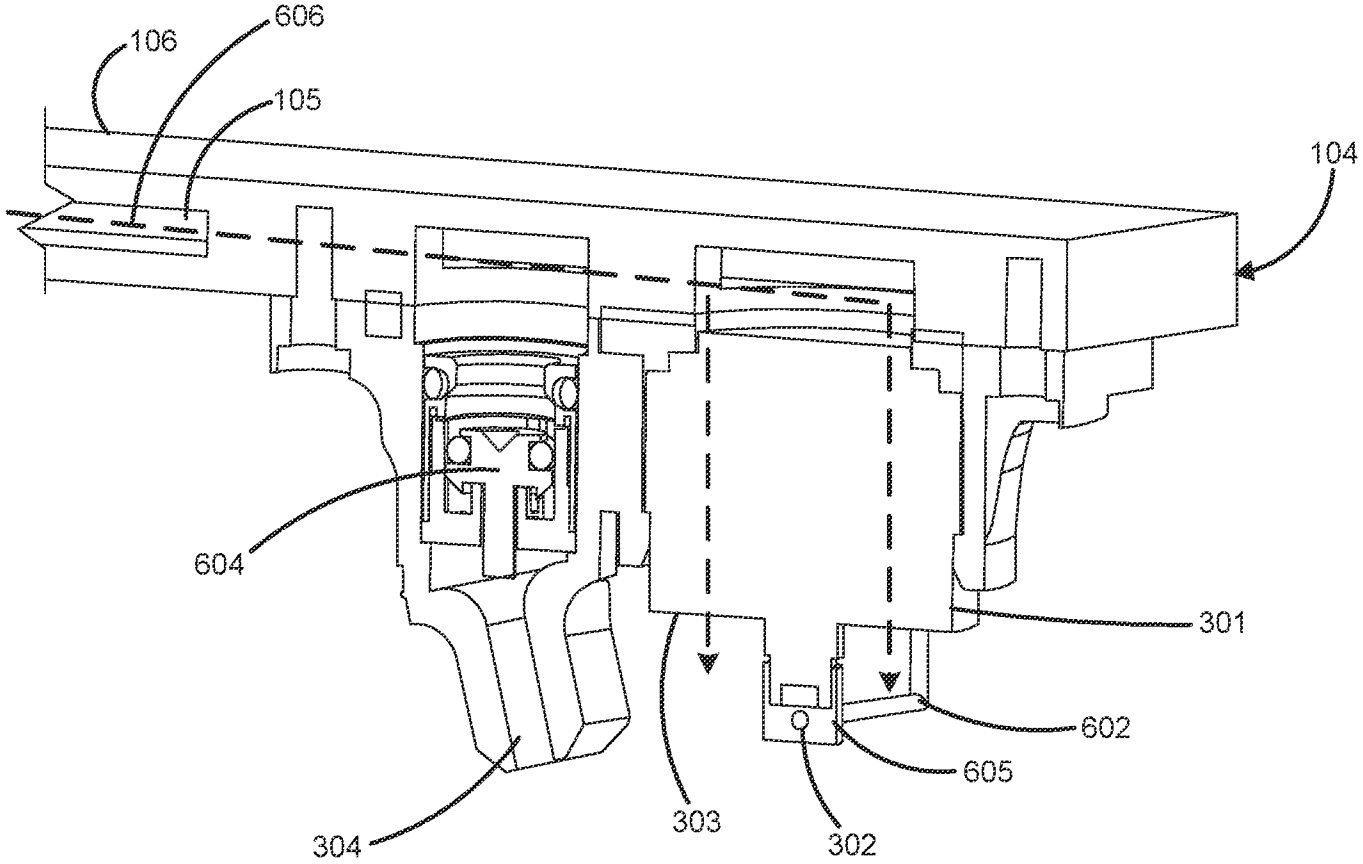
FIG. 6 illustrates a side cross-sectional view of the spray head controller in a first configuration.

FIG. 6 illustrates a further cross-sectional side view of the faucet spout 106 and outlet portion 104, including the first outlet 301 and second outlet 304. As shown, water follows a first water flow pathway 606 (e.g., leading through water passageway 105) where the water exits the outlet portion 104 through the first outlet 301 when the push seal 302 is in an open position, thereby allowing water to pass through the aerator 303. In a first embodiment, the first water flow pathway 606 is the default water flow pathway. The water may flow through the default pathway when the spray pattern controller 120 is not actuated. However, in alternative embodiments, the first water flow pathway 606 is the pathway the water flow takes with the spray pattern controller 120 is actuated.

In the embodiment shown, the push seal 302 may be positioned in an open position when the spray pattern controller 120 is not actuated or toggled, thereby allowing water to flow through the aerator 303 at the first outlet 301. As further explained below, a check valve within the second outlet 304 prevents water from concurrently flowing through the second outlet 304. This allows water to flow past the aerator 303 and into the push seal 302 though the outlet portion 104.

The push seal 302 includes an end portion 605 that is controlled by the spray pattern controller 120 via a linker 602. When the spray pattern controller 120 is not actuated, the linker 602 does not provide any pressure to the end portion 605 of the push seal 302, thereby allowing water to flow through the aerator 303.

When the spray pattern controller 120 is actuated, the linker 602 provides pressure or otherwise closes the end portion 605 of the push seal 302 so that water is not capable of flowing through the aerator 303. This causes water to back up within the body of the outlet portion 104, and eventually exits the second outlet 304, as described in more detail below.

Figure 7:
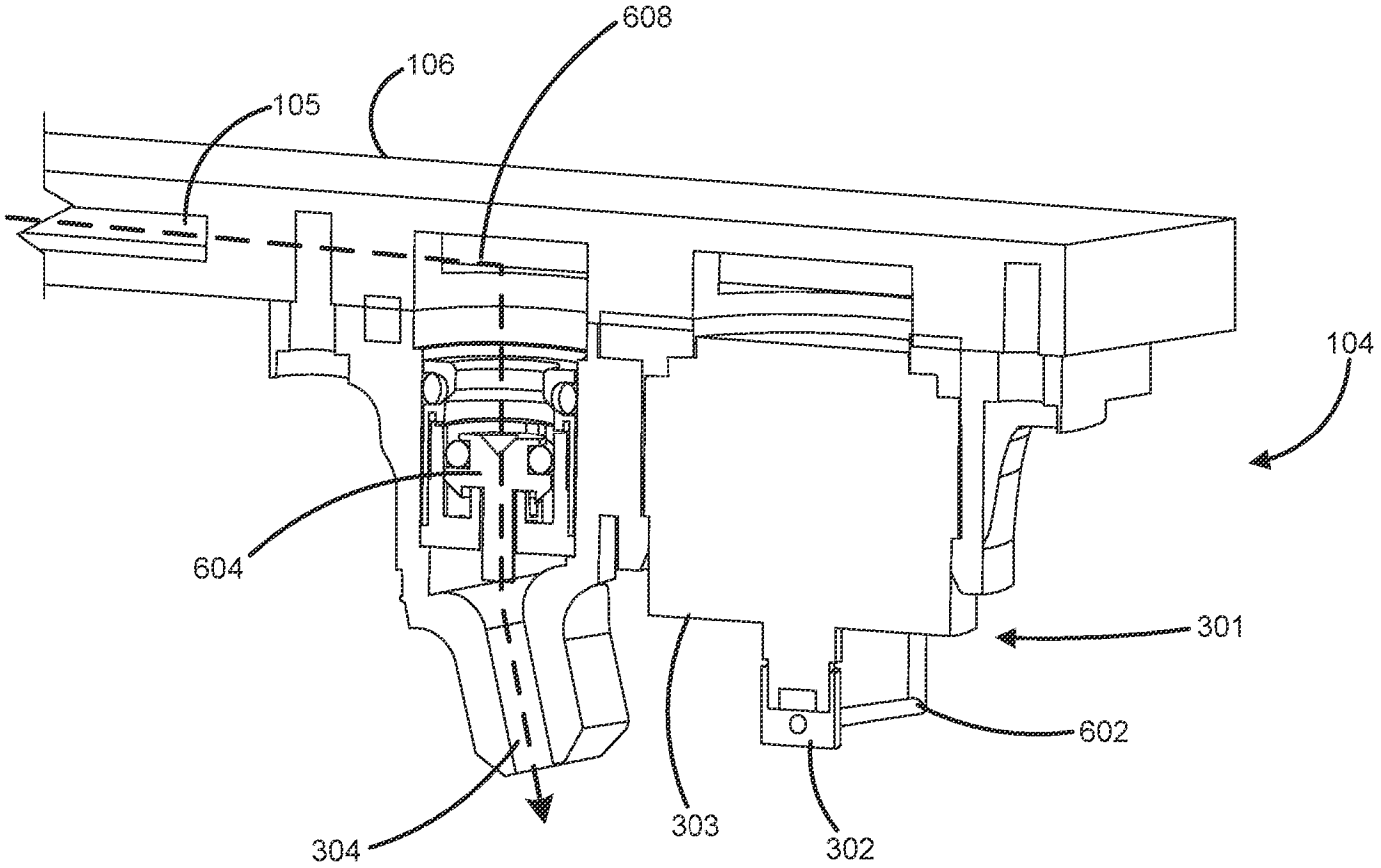
FIG. 7 illustrates a side cross-sectional view of the spray head controller in a second configuration.

FIG. 7 illustrates a cross-sectional side view of the faucet spout 106, the outlet portion 104, and the first and second outlets 301, 304. In the embodiment shown, water flows through a second pathway 608 (e.g., through water passageway 105), which is through the second outlet 304. As described above, when the spray pattern controller 120 is actuated, the end portion 605 of the push seal 302 is closed, which causes a backup of water and pressure within the outlet portion 104 (e.g., within water passageway 105). When enough back pressure is built up, a check valve 604 is opened, allowing water to flow through the second outlet 304.

Referring to FIGS. 6-7 generally, it can be seen that when water flows through the first outlet 301, a water pressure within passageway 105 will generally be lower than an actuating pressure of the check valve 604. As such, water may flow along the first water flow pathway 606, as seen in FIG. 6, without water flowing through the second outlet 304. However, upon actuation of the push seal 302 (e.g., by the spray pattern controller 120), pressure within the passageway 105 will increase since water is prevented from flowing through the aerator 303, until sufficient pressure has built within the passageway that the check valve 604 opens, allowing water to pass through the second outlet 304. Notably, because the second outlet has a relatively small aperture, a water pressure is maintained within the passageway 105, and therefore check valve 604 remains open, allowing a high-pressure, focused water spray pattern to be ejected from the second outlet 304.

Figure 8:
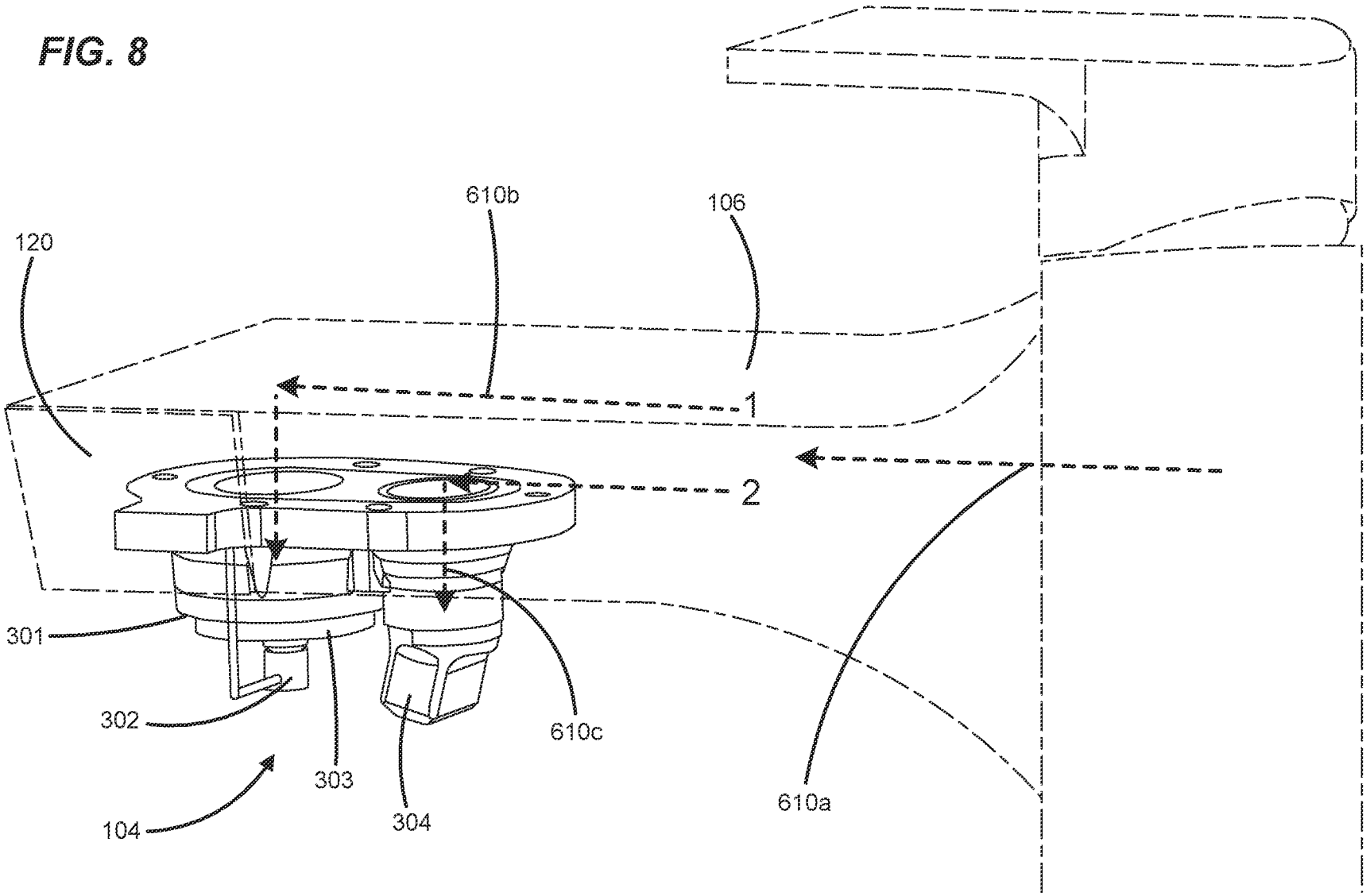
FIG. 8 illustrates a side cross-sectional view of an alternative embodiment of a spray head controller.

FIG. 8 illustrates an alternative embodiment of a faucet spout 106. In the embodiment as shown, a spray pattern controller 120 is located along a side of the faucet spout 106. In the embodiment shown, the spray pattern controller 120 controls a diverter (not shown) located upstream from the first outlet 301 and second outlet 304. The diverter (not shown) receives a first flow of water 610*a* and directs it based upon the actuation of spray pattern controller 120. The diverter (not shown) controls water in a binary fashion, and is capable of directing water either through the first pathway 610*b* or the second pathway 610*c*. In such an arrangement, the first pathway 610*b* leads water through the first outlet 301, and the second pathway 610*c* leads water through the second outlet 304. Notably, in some embodiments, the push seal 302 may be eliminated, since such a diverter will be provided by the "upstream" seal that is associated with the spray pattern controller 120. In still further examples, check valves may be used in both the first outlet 301 and the second outlet 304.

Figure 9A:
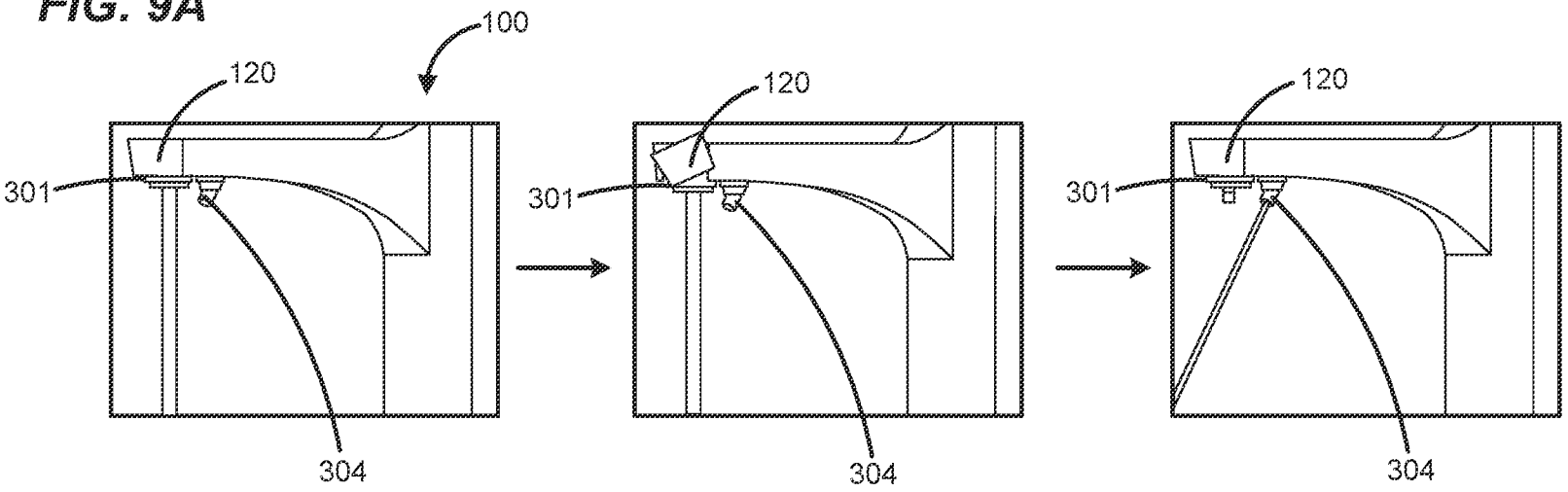
FIGS. 9A-9B illustrate example flow pattern changes when actuating the spray pattern controller of the faucet of FIG. 1.
Figure 9B:
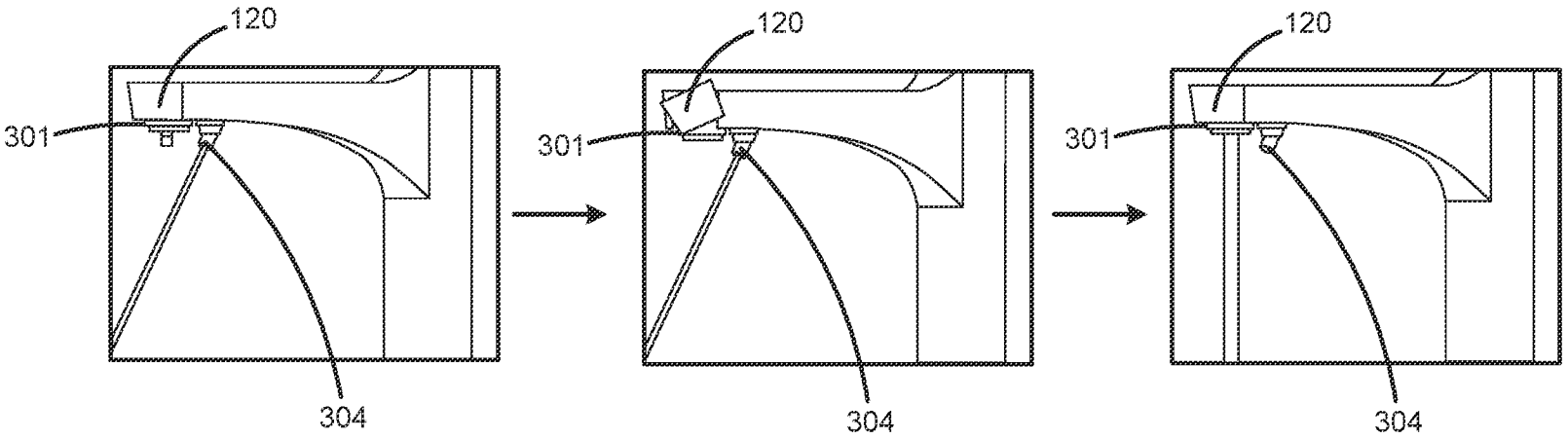

FIGS. 9A and 9B illustrates different example water flows when the spray pattern controller 120 is not actuated and then subsequently is actuated. A water flow through the first outlet 301, and in particular through the aerator 303, can provide a softer spray covering a wider area, while a water flow through the second outlet 304 can provide a more powerful stream with a focused area.

FIG. 9A illustrates an example of a change in the spray pattern based on the spray pattern controller 120 actuation. In the embodiment shown, initially when spray pattern controller 120 is not actuated, water flows through the first outlet 301. This provides a wider, softer water spray pattern. When the spray pattern controller 120 is actuated, the water still flows to the first outlet 301, but the push seal 302 is engaged. Accordingly, water is prevented from flowing through the aerator 303. Accordingly, once flow through the first outlet 301 is halted and pressure builds within the passageway 105, water may flow through the second outlet 304, providing the higher-pressure, more focused spray pattern.

FIG. 9B illustrates an example of a reversed sequence, in which a push seal 302 is initially closed and water flow is through the second outlet 304. In this example, the spray pattern controller 120 is again actuated by a user. The subsequent actuation of the spray pattern controller 120 opens the push seal 302. Water is then allowed to pass through the first outlet 301, and as pressure drops within the passageway 105, water flow through the second outlet 304 is halted by the check valve 604.

Referring to FIGS. 1-9 generally, the example faucet 100 as described herein includes a mechanism for providing different spray patterns. When actuated, the spray pattern controller 120 allows the flow of water through a first mechanism that provides a first flow pattern. When the spray pattern controller 120 is not actuated, it allows the flow of water through a second outlet 304 that provides a second flow pattern. That second flow pattern may be of a different pressure, different volume, different orientation, or from a different position along the faucet spout 106, in various embodiments contemplated herein.

Still further, although this disclosure will be discussed with regard to a bathroom faucet for purposes of example, the spray pattern controller system described herein could be implemented in any type of faucet, including kitchen faucets lacking a pull-down faucet feature.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

What is claimed is:

1. A faucet comprising:

a faucet body including a faucet handle, the faucet handle movable with respect to the faucet body;

a faucet spout having a first end extending from and integral to the faucet body and a second end having a first outlet and a second outlet, the first and second outlets disposed on an underside of the faucet spout;

a spray pattern controller located along a side of the faucet spout and at the second end of the faucet spout, the spray pattern controller configured to move between a first configuration and a second configuration that actuates a push seal at the first outlet to adjust a spray pattern selected from a plurality of spray patterns being dispensed through the faucet spout through at least one of the first outlet or the second outlet, wherein in the first configuration, the spray pattern controller aligns with a shape of the faucet spout at the second end, and in the second configuration, the spray pattern controller pivots to a non-aligned position relative to the shape of the faucet spout at the second end.

2. The faucet of claim 1, wherein the spray pattern controller is a mechanical switch.

3. The faucet of claim 2, wherein the mechanical switch is selected from among a toggle, a push button, and a rotary dial.

4. The faucet of claim 1, wherein the first outlet includes an aerator with the push seal, and the second outlet includes a check valve.

5. The faucet of claim 4, wherein when the push seal is closed and water pressure within the faucet spout exceeds a threshold of the check valve, water flows through the second outlet and does not flow through the first outlet.

6. The faucet of claim 4, wherein when the push seal is open, water flows through the aerator of the first outlet and does not flow through the second outlet.

7. The faucet of claim 1, wherein the spray pattern controller comprises a diverter to select between a plurality of waterways, wherein a first waterway provides a first flow pattern and a second waterway provides a second flow pattern, the second flow pattern different than the first flow pattern.

8. The faucet of claim 7, wherein the diverter is located within the faucet spout and the diverter is capable of controlling water flow through the first outlet or the second outlet.

9. The faucet of claim 1, wherein the plurality of spray patterns includes a first spray pattern and a second spray pattern, the first spray pattern having a first pressure and a first flow pattern cross-sectional area and a second flow pattern having a second pressure greater than the first pressure and a second flow pattern cross-sectional area that is smaller than the first flow pattern cross-sectional area.

10. The faucet of claim 1, wherein the faucet comprises a bathroom faucet.

11. The faucet of claim 1, wherein the faucet body comprises a rigid unitary body extending from a faucet base to the second end of the faucet spout.

12. A method of controlling a spray pattern dispensed from a faucet, the method comprising:

providing a spray pattern controller in a first configuration located along a side of an end of a faucet spout including a first outlet and a second outlet disposed on an underside of the faucet spout, wherein in the first configuration, the spray pattern controller aligns with a shape of the end of the faucet spout;

receiving a manual input from the spray pattern controller and moving the spray pattern controller to a second configuration, wherein in the second configuration, the spray pattern controller pivots to a non-aligned position relative to the shape of the faucet spout at the end, the spray pattern controller coupled to a push seal at the first outlet having an open position and a closed position;

wherein when the push seal is in the open position, water flows through the first outlet in a first spray pattern; and wherein when the push seal is in the closed position, the water flows through the second outlet in a second spray pattern that is different than the first spray pattern.

13. The method of claim 12, wherein the first spray pattern has a first pressure and a first flow pattern cross-sectional area and the second spray pattern has a second pressure greater than the first pressure and a second flow pattern cross-sectional area that is smaller than the first flow pattern cross-sectional area.

14. The method of claim 12, wherein the spray pattern controller comprises a toggle, and the manual input comprises adjusting the toggle to actuate the push seal between the open and closed positions.

15. The method of claim 12, wherein:

when the push seal is in the open position, water flow through the second outlet is halted; and when the push seal is in the closed position, water flow through the first outlet is halted.

16. A faucet comprising:

a faucet body extending from a faucet base located at a sink deck, the faucet body comprising a faucet handle movable with respect to the faucet body to manipulate a cartridge configured to control water flow at the faucet;

a faucet spout defining a flow pathway and having a first end extending from and integral to the faucet body and a second end having a first outlet and a second outlet, the first outlet and the second outlet in flow communication with the flow pathway and wherein the first outlet has a push seal and the second outlet has a check valve, the first and second outlets disposed on an underside of the faucet spout; and a spray pattern controller adjacent the second end of the faucet spout, the spray pattern controller being operatively engaged with the push seal at the first outlet, the spray pattern controller configured to adjust a spray pattern selected from a plurality of spray patterns being dispensed through the faucet spout by toggling between output from the first outlet or the second outlet wherein when the push seal is closed water flows through the second outlet with a pressure that opens the check valve and when the push seal is open water flows through the first outlet with the check valve being closed.

17. The faucet of claim 16, wherein, when the push seal is open water flows through an aerator of the first outlet.

* * * * *